United States Patent [19]

Reynaud

[11] 4,133,617

[45] Jan. 9, 1979

[54] VANE TYPE PUMP WITH OPTIONAL HIGH RATE OF FLOW OR HIGH PRESSURE CHARACTERISTICS

[75] Inventor: Denis A. L. M. Reynaud, Mexico City, Mexico

[73] Assignee: Thomas Roach, Hazelwood, Mo.

[21] Appl. No.: 780,775

[22] Filed: Mar. 24, 1977

Related U.S. Application Data

[63] Continuation-in-part of Ser. No. 652,795, Jan. 27, 1976, abandoned.

[51] Int. Cl.[2] ..... F01C 1/00; F01C 21/10; F04C 1/00

[52] U.S. Cl. ..... 418/150; 418/255

[58] Field of Search ..... 418/150, 255

[56] References Cited

U.S. PATENT DOCUMENTS

| | | | |
|---|---|---|---|
| 102,140 | 4/1870 | Mather | 418/255 |
| 893,454 | 7/1908 | Daniels | 418/255 |
| 939,911 | 11/1909 | Heimann et al. | 418/255 |
| 1,442,198 | 1/1923 | Utley | 418/255 |
| 1,649,256 | 11/1927 | Roessler | 418/255 |
| 1,728,620 | 9/1929 | Lateur | 418/255 |
| 2,876,706 | 3/1959 | Baus | 418/255 |

FOREIGN PATENT DOCUMENTS

| | | | |
|---|---|---|---|
| 595639 | 12/1947 | United Kingdom | 418/255 |
| 697078 | 9/1953 | United Kingdom | 418/255 |

*Primary Examiner*—John J. Vrablik
*Attorney, Agent, or Firm*—Michael Kovac

[57] ABSTRACT

An improved vane type pump capable of operating either as a high rate of flow or high pressure pump change of rotation only is disclosed. The construction, arrangement and dimensioning of the operative elements of the improved vane type pump provides an angle of intercommunication between inlet and outlet means during rotation and an automatic liquid seal to assure an uninterrupted flow of liquid being pumped through inlet means for discharge through outlet means.

4 Claims, 7 Drawing Figures

FIG. 3
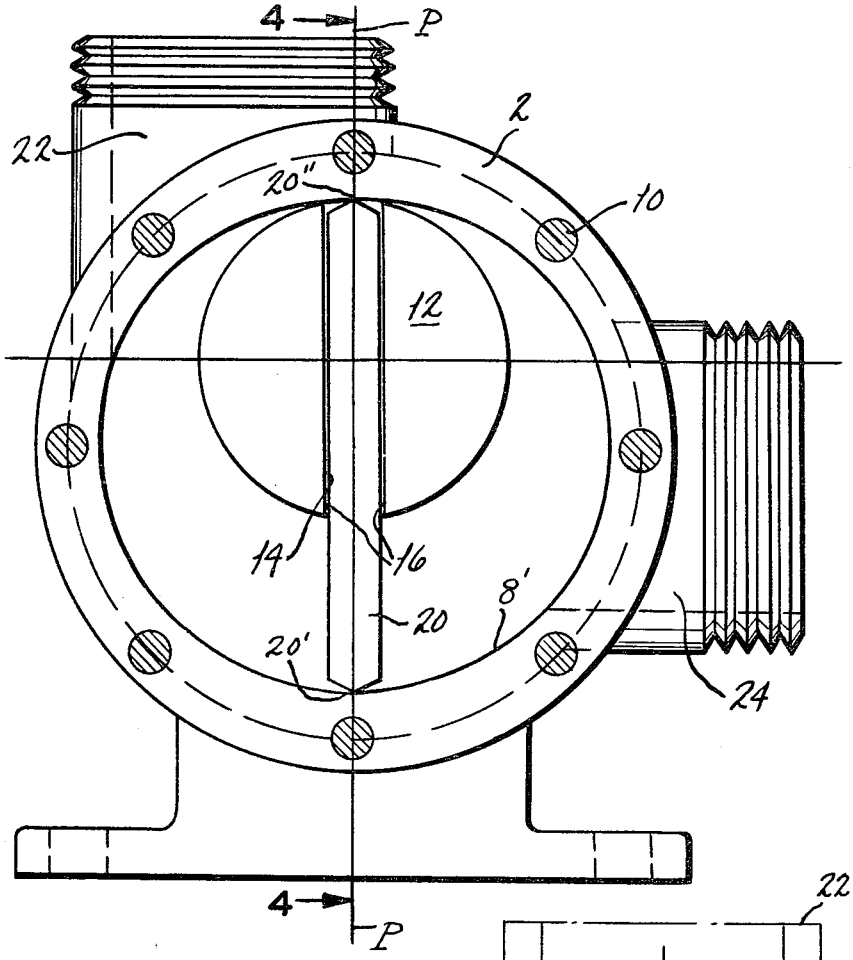
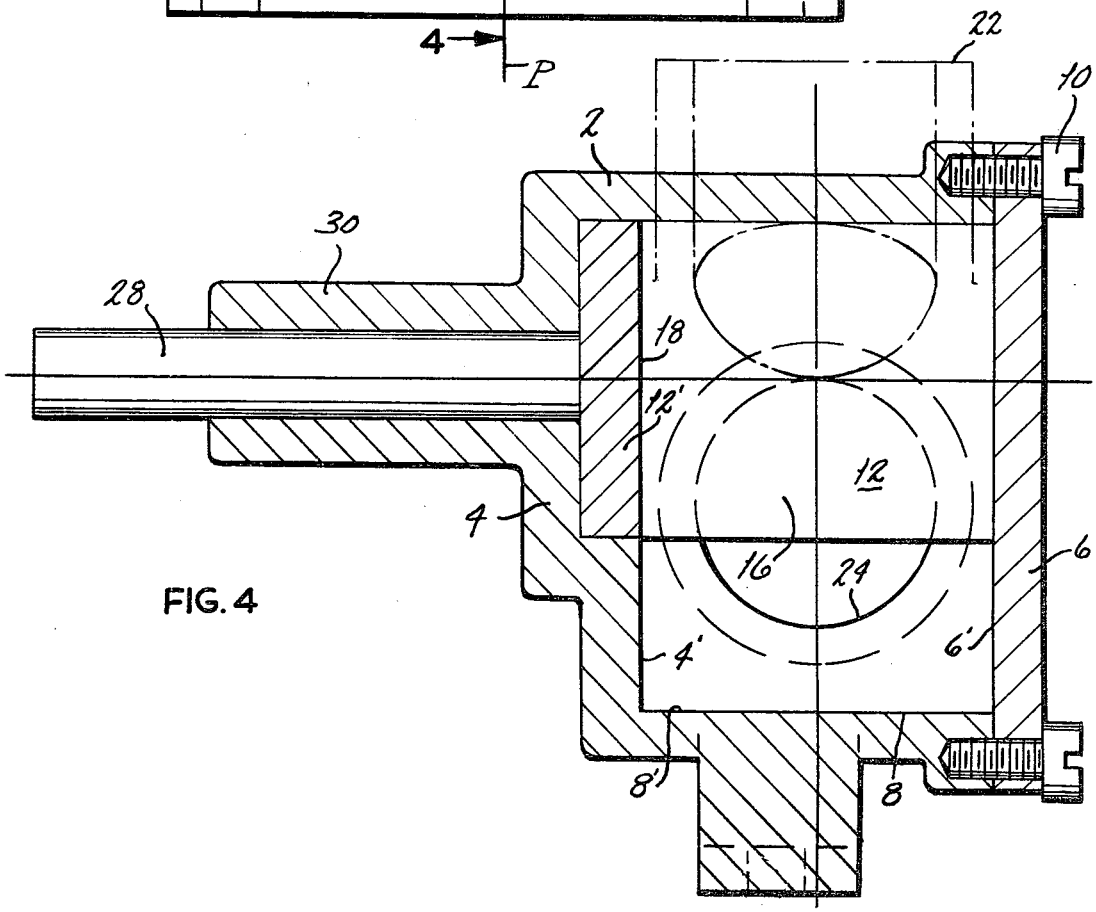
FIG. 4

VANE TYPE PUMP WITH OPTIONAL HIGH RATE OF FLOW OR HIGH PRESSURE CHARACTERISTICS

BACKGROUND OF THE INVENTION

This is a continuation in-part of my patent application Ser. No. 652,795 filed Jan. 27, 1976, now abandoned.

Vane type pumps are well known in the art and they usually comprise a cylindrical housing provided with fluid inlet and outlet means for feeding fluid into the interior of the housing and for discharging fluid therefrom. A rotatable drum is mounted in the interior of the housing eccentrically arranged with respect to the usual circular cylindrical inner surface of the housing, and the drum is provided with one or a plurality of radially extending slots into which one or a plurality of plates or vanes are respectively slidably arranged and are sometimes forced by springs or other means so as to urge the outer edges thereof against the inner surface of the housing for sealing contact therewith. The vanes thus divide the space between the outer surface of the rotatable drum and the inner surface of the housing into several or a plurality of chambers successively increasing and decreasing in volume during rotation of the rotatable drum and the vane or vanes guided in the slots thereof so that when the rotatable drum is rotated by an external motor, fluid entering into the interior of the housing through the inlet means will be forced under pressure out of the outlet means and the device will act as a pump. Typical prior art examples are U.S. Pat. Nos. 893,454; 1,317,352; 1,649,256; 1,719,134; and 2,903,971.

It is also well known that in any pump, a big rate of flow will be obtained with a very low pressure and a big pressure will be obtained with a very small rate of flow, and that a specific design of a pump will serve only one purpose.

It is one object of the present invention to overcome the disadvantages of vane type pumps.

It is another object of the present invention to provide an improved vane pump combining two devices in one, working like a high rate of flow pump when rotated in one direction and working like a high pressure pump when rotated in the opposite direction, without any other adjustment or modification.

It is an additional object of the present invention to provide for a vane type pump which is composed of only few, and relatively simple parts which can be manufactured at very reasonable cost and which will stand up under extended use.

With these objects in mind, the fluid pump according to the present invention mainly comprises a housing in the form of a straight hollow cylinder having a pair of end walls with inner planarwise parallel end faces and an endless wall extending between the end faces and having an inner guide surface defining in a plane normal to the generatrices of the cylinder a cross-sectional contour in the form of a spiral of Pascal. A rotary drum in the form of a straight circular cylinder is arranged within the hollow cylinder extending through the interior of the same, symmetrically arranged with respect to a plane of symmetry normal to the end faces of the latter and contacting the aforementioned guide surface substantially along a line in the aforementioned plane of symmetry. The drum is formed with a diametrically extended groove therethrough, and a plate or vane is slidably guided in the groove extending in an axial direction between the end faces of the housing and transversely across the interior of the same. The vane has opposite edge portions each contacting the inner surface of the housing with a line contact. Fluid inlet and fluid outlet means communicating with the interior of the hollow cylinder through the endless wall and the fluid inlet and outlet means are assymmetrically arranged on opposite sides of the aforementioned plane of symmetry, their function being determined by the direction of the rotation as determined by the purpose of the pumping.

The device includes further shaft means extending coaxially with the rotary drum through one of the end walls of the housing, connected to the drum for rotation therewith whereby when the shaft means and the drum are rotated, the plate will be rotated therewith while oscillating with respect to the drum so as to force fluid entering the housing through the inlet means with increasing pressure out of the outlet means by the development of an automatic liquid seal to assure an uninterrupted flow of liquid being pumped through the inlet means for discharge through the outlet means.

BRIEF DESCRIPTION OF THE DRAWINGS

FIG. 3 is a cross-sectional front view through a pump according to the present invention;

FIG. 4 is a cross-sectional side view of the device shown in FIG. 3;

DESCRIPTION OF THE PREFERRED EMBODIMENTS

Figure 1:
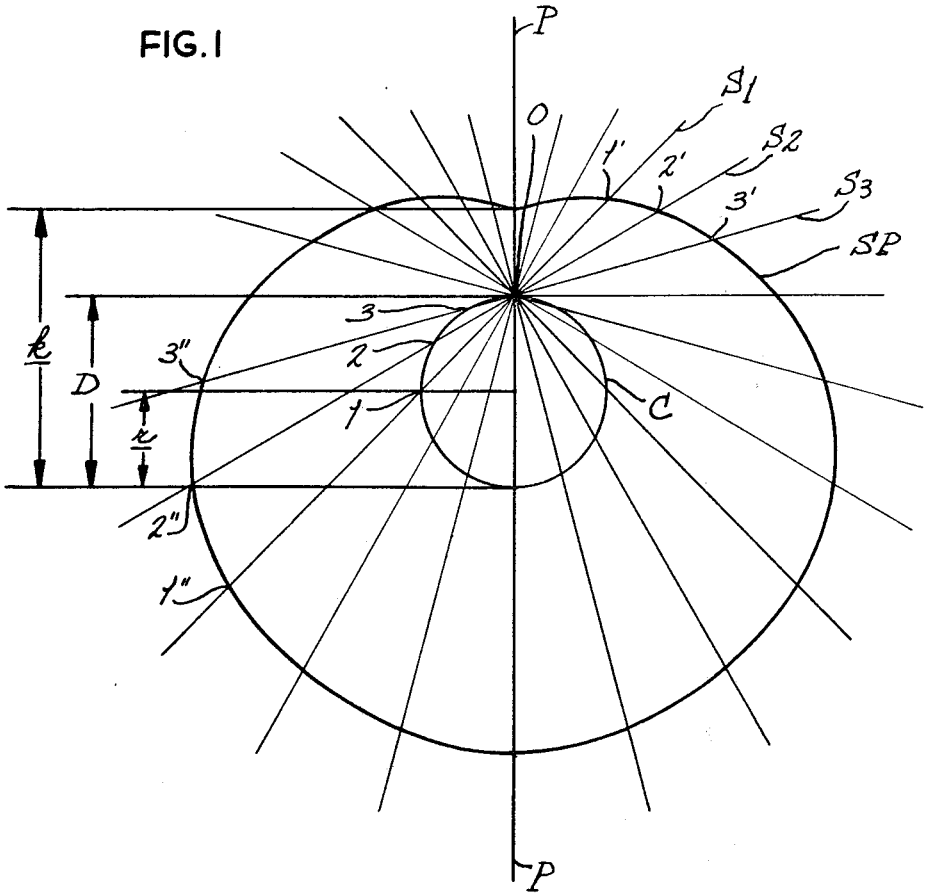
FIG. 1 is a schematic figure illstrating a spiral of Pascal and one way of constructing the same.

Refering now to the drawings, and more specifically to FIGS. 3 and 4, it will be seen that the pump according to the present invention comprises a hollow cylindrical housing 2 having a pair of end walls 4, 6 with inner planarwise parallel end faces 4' and 6', and an endless wall 8 extending between the end walls 4 and 6. The end wall 4 is shown in FIG. 4 integrally made with the endless wall 8 while the end wall 6 is constructed as a separate cover connected by screws 10 to a flange formed at one side of the endless wall 8. The endless wall 8 has an inner guide surface 8', defining in a plane normal to the generatrices of the straight cylinder formed by the wall 8, a cross-sectional contour in the form of a curve generally known as spiral of Pascal, the specific configuration and construction thereof which will later be explained in detail. A rotary drum 12 in the form of a straight circular cylinder extends through the interior of the hollow cylinder formed by the housing 2 symmetrically arranged with respect to a plane of symmetry P normal to the end faces of the latter and contacting the guide surface 8' substantially along a line in the plane of symmetry so as to be in sealing contact along this line with the inner guide surface 8'. The rotary drum 12 is formed with a diametrically extending groove 14 therethrough which extends in an axial direction from the end face 6' to the end face 4'. Groove 14 has a pair of parallel side faces 16 spaced a given distance from each other and an end face 18 located in one plane with the end face 4' of end wall 4. As can be seen from FIG. 4, the rotatable drum 12 extends with a portion 12' beyond the plane of the end face 8, which portion is located in a corresponding cavity formed in the end wall 4. A plate or vane is slidably guided in the groove 14 formed in the rotatable drum 12 and the plate extends in axial direction between the end faces 4' and 6', and transversely across the interior of the housing 2. Plate 20 has a pair of opposite-edge portions 20', 20'', each contacting the guide surface 8' with a line contact so as to be in substantial sealing contact therewith.

The housing is also provided with fluid inlet means and fluid outlet means 22 and 24 communicating with the interior thereof and assymetrically arranged on opposite sides of the plane of symmetry P. The inlet and outlet means 22 and 24 are peripherally separated with respect to the cylindrical housing through an angle of at least 90.

Shaft means 28 extend coaxially with the rotary drum 12 through the end wall 4 and the shaft means 28 may be formed integrally with the drum 12 or be connected hereto in any known manner for rotation therewith. A hub 30 projects outwordly from the end wall 4 providing a bearing for the shaft means 28. Appropriate seals, not shown in the drawing, may be provided in the hub 30 around the shaft 28 and also between the engaging faces of the end wall 6 and the flange of the endless wall 8.

During rotation of the shaft means 28 and the rotatable drum 12, the plate 20 guided in the slot 14 of the rotatable drum will rotate with the latter while oscillating in the slot relative to the drum, and during such rotation and oscillation of the plate 20, the end edges thereof 20' and 20'' will stay in contact with inner guide surface 8'. Since the rotatable drum 12 is arranged so as to contact the inner guide surface 8' only along a line located in the plane of symmetry P, and since the end edges 20' and 20'' of the plate have to stay in contact with the inner guide surface 8' during such rotation and oscillation of the plate, the inner guide surface 8' can obviously not be a circular cylindrical surface, but the inner guide surface has, in a plane normal to the axis of the hollow cylinder, a cross-sectional contour in the form of a curve, commonly known as a spiral of Pascal.

FIG. 1 illustrates the general configuration and construction of this curve. The curve or spiral of Pascal SP shown in FIG. 1 is constructed by drawing through a fixed point O of a circle C a plurality of secants S1, S2, S3, and so on, which respectively intersect the circle C in the points 1, 2 and 3 and by then determining on each secant two points located a fixed distance K on opposite sides of the respective intersection point of the secant with the circle C. In this way, the points 1', 1'' are obtained on the secant as 1, the points 2', 2'' on the secant as 2, and the points 3', 3'' on the secant as 3, and so on. When those end points are all connected to each other, the resulting curve will be a Spiral of Pascal. The curve can therefore be defined as the locus of all points which are respectively spaced equal distances from the intersection points of secants drawns through a fixed point of a circle. The cartesian coordinates of this curve are $(x^2 + y^2 - 2rx)^2 = x^2 + y^2)$ wherein r is the radius of the aforementioned circle and k the distance measured from the respective intersection points of the secants drawn through the fixed point O of the circle to the opposite sides of the intersection points.

The specific configuration of the curve will depend on the relationship of the radius or diameter of the base circle C and the fixed distance k.

When D = k, the curve obtained is a cardioid that is a curve similar to that shown in FIG. 1, but forming a sharp inwardly directed angle at the line of symmetry P of the curve.

When 2D = k, the upper portion of the curve will have, as shown in FIG. 1, a radius of curvature located outside of the curve while the lower portions thereof, as viewed in FIG. 1, will all have radii of curvatures located inside of the curve, so that the upper part of the curve will present an undulation OZ wave, as shown in FIG. 1.

When 3D = k, the curve has no undulation any more, and the radii of curvature of all portions of the curve will be located inside the curve and when the ratio D divided by k approaches zero, the curve will approach the configuration of a circle.

According to the present invention it is preferred to construct the inner guide surface of the endless wall of the housing to extend along a curve constructed as described above, where in the ratio D/k is between one third and a value greater than zero, depending on the speed with which the device is to be operated and on the desired displacement of fluid or fluid pressure. The ratio $D/k = \frac{1}{3}$ will provide for the greatest displacement at each revolution which displacement will diminish as the selected ratio diminishes.

Figure 2:
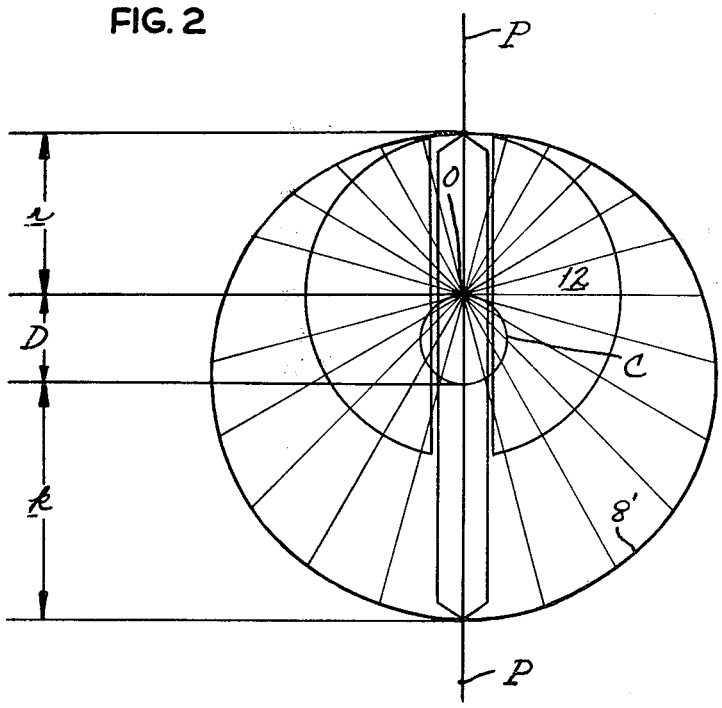
FIG. 2 is a schematic figure illustrating a special form of spiral of Pascal, preferably used as outline for the endless wall of the housing, according to the present invention and illustrating also the arrangement of the other elements of the pump.
Figure 5:
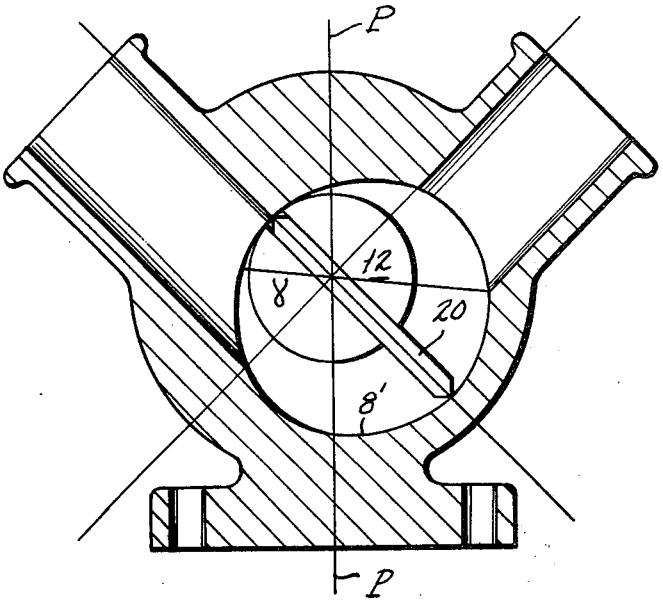
FIG. 5 is a cross-sectional front view through a pump according to the present invention with exterior bilateral symmetry.

FIG. 2 illustrates a curve of the aforementioned type constructed with a ratio of $D/k = \frac{1}{3}$ and this figure illustrates also schematically the arrangement of the members of a vane type pump according to the present invention arranged with respect to the inner guide surface 8' having a cross-sectional contour of the curve mentioned. In this arrangement, the axis of the rotatable drum 12, coincides with the aforementioned fixed point O of the circle C and the diameter of this rotatable drum is equal to D + k, in order to provide sealing contact with the inner guide surfaces 8' along a line located in a plane of symmetry P of this curve.

Figure 6:
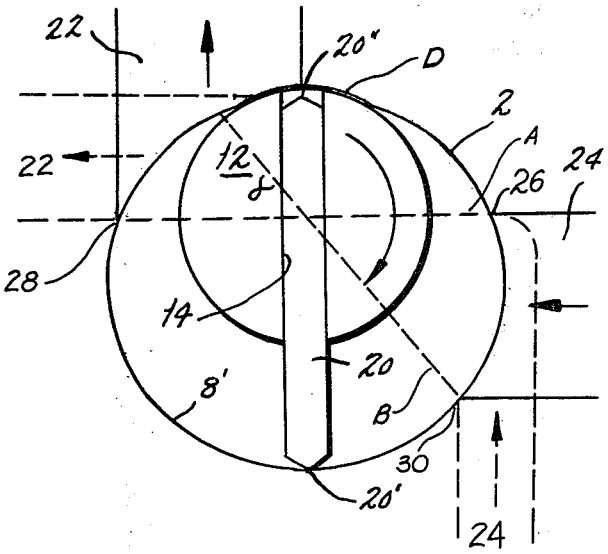
FIG. 6 is a schematic figure illustrating the positioning of the inlet means and outlet means, according to the rotation, where a high rate of flow is required.
Figure 7:
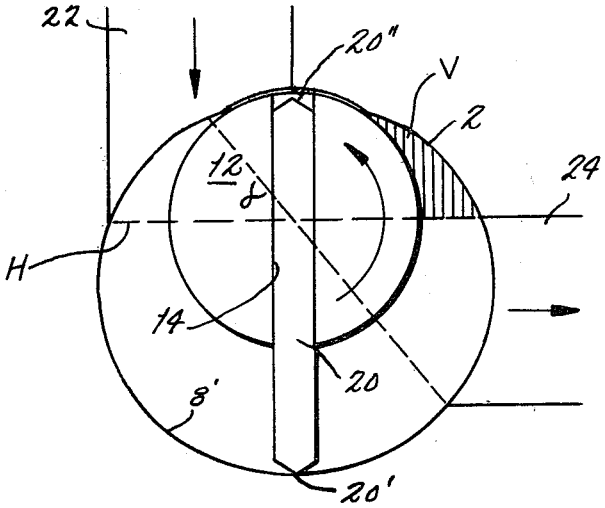
FIG. 7 is a schematic figure illustrating the positioning of the inlet means and outlet means, according to the rotation, when a high pressure is required.

The construction, arrangement and the dimensioning of the inlet and outlet means 22 and 24 relative to the other parts is of great importance as will now be explained. FIG. 6 and FIG. 7 illustrate the positioning of the inlet and outlet means, 22 and 24; 24 is the inlet means and 22 the outlet means when rotating clockwise; 22 is the inlet means and 24 the outlet means when rotating counter-clockwise.

When the device is operated as a high rate of flow pump as shown in FIG. 6, and fluid is fed through the inlet means 24 into the interior of the housing 2, this fluid will fill the space between the outer surface of the rotatable drum 12 and the inner guide surface 8' of the housing to the right side of the plate 20, as viewed in FIG. 6. During rotation clockwise of the drum 12, and therewith rotation of the plate 20 slidably guided in the slot 14 of the drum, the space in the interior of the housing to the right side of the plate 20, as viewed in FIG. 6, will be enlarged so that fluid will be sucked from the inlet 24 into the enlarging space. During rotation of the plate 20, the end edge 20'' will pass beyond the inlet means 24 and the fluid located in the interior of the housing beneath the plate portion projecting beyond the right side of drum 12 will be propelled toward the outlet means 22 to be discharged therefrom as the edge portion 20′ passes the outlet means 22.

When the device is operated as a high pressure pump as shown in FIG. 7, and fluid is fed through the inlet means 22 into the interior of the housing 2, this fluid will fill the space between the outer surface of the rotatable drum 12 and the inner guide surface 8′ of the housing to the left side of the plate 20 as viewed in FIG. 7. During rotation counter-clockwise of the drum 12, and therewith rotation of the plate 20 slidably guided in the slot 14 of the drum, the space in the interior of the housing to the left side of the plate 20, viewed in FIG. 7, will be enlarged so that fluid will be sucked from the inlet 22 into the enlarging space. During rotation of the plate 20, the end edge 20″ will pass beyond the inlet means 22, and the fluid located in the interior of the housing beneath the plate portion projecting beyond the left side of drum 12 will be propelled toward the outlet means 24 to be discharged therefrom as the edge portion 20′ passes the outlet means 24.

In both operations, the construction, arrangement and dimensioning of the inlet and outlet means relative to the operative elements of the pump is such as to provide an automatic liquid seal to assure an uninterrupted flow of liquid being pumped through the inlet means for discharge through the outlet means. More specifically, the automatic liquid seal is formed by pressure in the sector between the outlet means and the line of sealing contact between the inner guide surface 8′ of the hollow cylinder 2 and the rotary drum 12. As seen in FIG. 7, the volume V depicted by the shaded sector area, between the outlet means and line of contact between the hollow cylinder 2 and the drum 12, is filled with liquid, twice in each revolution, by the pressure of discharge. Thus, when the vane 20 reaches a horizontal position depicted by the dotted line H from the vertical position as shown in FIG. 7, the liquid trapped in the volume V becomes pressurized by the vane motion. The trapped liquid in the volume V thus acts as an automatic liquid seal or seal of liquid to prevent the return of liquid already pumped through the inlet means into the hollow cylinder 2. The angle of rotation of the operative elements during which both the inlet and outlet means are in communication is such as to prevent fluid recirculation or back pressure, due to the inertia of the fluid even at very low speed.

It will be appreciated that the automatic liquid seal is enhanced by the liquid that is forced between the tolerances existing between the lines of contact of the different moving parts of the pump, including the line of contact between the inner guide surface 8′ of the cylinder 2 and drum 12, the line of contact between the vane edge 20′, 20″ and the inner guide surface 8′ of the hollow cylinder 2, and the line of contact between the vane 20 and the slot 14 of the drum 12, all of the aforementioned line of contacts being developed with respect to the associated position and assymetrical arrangement of the inlet and outlet means, 22 and 24. Thus, the pump cannot lock or become damaged since any excess liquid that is developed by the automatic liquid seal during rotation of the parts is forced between the tolerance as set forth above, while the automatic liquid seal or seal of liquids is maintained.

In addition to or in lieu of using tolerance differences to remove any excess liquid, a small depression D may be formed in the housing 2 in the area of juncture of the guide surface 8 with the outlet means 22 to retain any excess liquid developed by the automatic liquid seal. For example, the depression D may have a maximum depth of 0.015 while the diameter of the rotary drum 12 can be increased 0.030. Thus, the plate 20 creates a seal at all points of contact with the inner guide surface 8 except at depression D where the plate 20 is forced downward centrifugally. As seen in FIG. 6, this creates a gap between the upper end of the plate 20 and the depression D to allow a small amount of liquid to remain in the depression D, while the enlarged rotary drum 12 serves to engage the outer peripheral edge of the depression D to maintain the liquid seal. This particular arrangement provides tighter tolerances between the parts; assures a liquid seal past the point of the fluid outlet; cuts the noise factor due to lack of pressure; and provides less drag on the moving surfaces.

As seen in FIG. 7, the assymetrical arrangement of the fluid inlet means 24 and fluid outlet means 22 is such as to provide the least restriction to fluid flow by being located with respect to the rotary drum 12 and associated slideably mounted vane 20 by an angle of intercommunication $\alpha$ between the fluid inlet 24 and fluid outlet 22, twice during each revolution. The angle of intercommunication $\alpha$ is defined by first and second intersecting planes A and B respectively. The first plane A extends through the axis of said drum 12 and is in alignment with a marginal surface 26 of the inlet means 24 at its area of intersection with the guide surface 8′, as well as intersecting another marginal surface 28 of the fluid outlet means 22 also at its area of intersection with the guide surface 8′. The second plane B also extends through the axis of the drum 12 and intersects yet another marginal surface 30 at its area of intersection with the guide surface 8′ which is generally opposite to the marginal surface 26 of the fluid inlet means 24 that is in general alignment with the first plane A.

It is to be noted that the dotted representations of fluid inlet 24 and fluid outlet 22 illustrates similar assymetrical arrangements with different directions of initial flow to and removal from the pump. Several different arrangements are possible, as will be apparent.

Thus, there is a substantial angle $\alpha$ of intercommunication between inlet and outlet means, twice in each revolution, which provides the least restriction to fluid flow.

By developing the automatic liquid seal, twice in each revolution, whether operating as a high pressure or high rate of flow pump, together with the angle of intercommunication between inlet and outlet means, the least amount of restriction to fluid flow is provided and back or reverse pressure into the inlet is eliminated. This enables the pump to operate at high speed as compared to other back pressure operating pumps.

In both operations, the pump will work by variation of volumes, increasing on both sides of the vane 20, the automatic liquid seal provided by the line of tangency or contact between inner guide surface 8′ and the rotary drum 12.

The various elements of the device according to the present invention can be made from different materials which can be selected, as desired, according to the application of the device. Various arrangements of different materials have worked out successfully in practice.

I claim:

1. A fluid pump comprising, in combination, means defining a housing of straight hollow cylindrical character having a pair of end walls with inner planarwise parallel end faces and an endless wall extending between said end faces and having an inner guide surface defining in a plane normal to the generatrices of said cylinder a cross-sectional contour of a spiral of Pascal, a rotary drum of straight circular cylindrical character extending through the interior of said housing being symmetrically arranged with respect to a plane of symmetry normal to the end faces of the latter and contacting said guide surface along a line in said plane of symmetry, said drum being formed with a diametrically extending groove therethrough, a vane slidably guided in said groove extending in axial direction between said end faces and transversely across the interior of said housing and having opposite edge portions each contacting said guide surface with a line contact, fluid inlet means communicating with the interior of said housing through said endless wall, fluid outlet means communicating with the exterior of said housing through said endless wall, said fluid inlet and outlet means being assymmetrically arranged at opposite sides of said plane of symmetry, said assymetrically arranged fluid inlet and outlet means also providing the least restriction to fluid flow by being located with respect to said rotary drum and associated slidably mounted vane by an angle of intercommunication between said fluid inlet and outlet means, twice during each revolution of said drum and associated vane, which angle of intercommunication is defined by first and second intersecting planes, said first plane extending through the axis of said drum and being in general alignment with a marginal surface of one said inlet or outlet means at its area of intersection with said guide surface and intersecting another marginal surface of said other fluid inlet or outlet means at its area of intersection with said guide surface, and a second plane also extending through the axis of said drum and intersecting yet another marginal surface of one of said fluid inlet or outlet means at its area of intersection with said guide surface which is generally opposite to said marginal surface of one of said fluid inlet or outlet means that is in general alignment with said first plane, means providing an automatic seal of liquids formed by pressure in the sector defined by the area between the outlet means and the line of contact between the inner guide surface of the housing and the rotary drum, and a shaft extending co-axially with said rotary drum through one of said end walls and being engaged on said drum for rotation therewith, whereby when said shaft and said drum are rotated with vane will be rotated therewith while oscillating with respect to the drum so as to force fluid entering said housing through said inlet means with increased pressure out said outlet means so that the device will act as a pump.

2. A fluid pump according to claim 1 wherein said pump when rotated in one direction acts as a high rate of flow pump and when rotated in an opposite direction acts as a high pressure pump.

3. A fluid pump according to claim 1 wherein said last mentioned means includes tolerance differences between the housing and rotary drum.

4. A fluid pump according to claim 1 wherein said last mentioned means includes depression means formed in the inner guide surface of said housing.

* * * * *